US008528593B2

(12) United States Patent
Stahl

(10) Patent No.: US 8,528,593 B2
(45) Date of Patent: Sep. 10, 2013

(54) BLEED AND FEED DEVICE AND METHOD

(75) Inventor: Juerg Stahl, Winterthur (CH)

(73) Assignee: ancosys GmbH, Kirchentellinsfurt (DE)

( * ) Notice: Subject to any disclaimer, the term of this patent is extended or adjusted under 35 U.S.C. 154(b) by 215 days.

(21) Appl. No.: 12/930,792

(22) Filed: Jan. 18, 2011

(65) Prior Publication Data

US 2011/0174379 A1 Jul. 21, 2011

(30) Foreign Application Priority Data

Jan. 18, 2010 (DE) ..... 10 2010 004 966

(51) Int. Cl.
*E03B 11/00* (2006.01)

(52) U.S. Cl.
USPC ..... 137/565.3; 137/563; 137/571

(58) Field of Classification Search
USPC ..... 137/392, 563, 565.3, 571; 118/715; 205/650
See application file for complete search history.

(56) References Cited

U.S. PATENT DOCUMENTS

| | | | | |
|---|---|---|---|---|
| 5,047,129 | A * | 9/1991 | Nardo | 134/18 |
| 5,223,156 | A * | 6/1993 | Maier | 210/800 |
| 5,792,343 | A * | 8/1998 | Fujita et al. | 210/96.1 |
| 6,471,845 | B1 * | 10/2002 | Dukovic et al. | 205/81 |
| 6,918,406 | B2 * | 7/2005 | Bae et al. | 137/340 |
| 2004/0142566 | A1 | 7/2004 | Frey et al. | |

FOREIGN PATENT DOCUMENTS

WO WO 2004/094701 A2 11/2004

* cited by examiner

*Primary Examiner* — John Rivell
*Assistant Examiner* — R. K. Arundale
(74) *Attorney, Agent, or Firm* — Kriegsman & Kriegsman

(57) ABSTRACT

Method for carrying out a bleed and feed of process solutions in a process tank. The feed solution is pumped out of a first tank into a first receiving space. The first receiving space is subsequently emptied into the process tank of with a pump. The volume of delivered feed solution in the process tank is measured. The bleed solution is pumped from the process tank with a pump into a second receiving space. The volume of delivered bleed solution in the second receiving space is measured. The bleed solution in the second receiving space is subsequently emptied into the second tank. The first receiving space differs from the second receiving space. A correction factor is calculated by comparing the measured and calculated volumes of the bleed and feed solution delivered by the pumps, with which correction factor the nominal delivery volume of the pumps are corrected in the next cycle.

24 Claims, 9 Drawing Sheets

BLEED AND FEED DEVICE AND METHOD

Bleed and feed devices and methods are employed in many chemical production processes, such as, for example, in semiconductor manufacturing.

The aim of this type of subsequent dispensing is to achieve constant concentrations of the individual substances in a mixture or bath during production over a longer period. With this mode of operation, it is also possible to keep substances, which accumulate during the length of use, constant during the dilution.

This is usually achieved with a 'feed' solution, which has a higher concentration than the nominal concentration and only contains the substances which are used. The addition of the feed solution is mostly carried out in load dependent time intervals with constant volumes. For example, between 5% and 30% of the whole bath volume is replaced once a day.

The 'bleed', that is to say, the removal, is carried out by a passive overflow at the tank or by a pump, which is controlled by a maximum-minimum sensor. Decomposition products, which develop during the production process, are regularly diluted in this way, and can be kept under a critical concentration over a longer period.

This concept of process control has several disadvantages, especially in processes which place higher requirements on the constancy of the concentration of the individual substances in the mixture, such as, for example, semi conductor technology. As a result of the supply in time intervals, the system determines a sawtooth course of the concentrations in the mixture. The production process must also be partly stopped at the time of supply, since the volume and the concentrations in the tank fluctuate depending on the products which are in the tank or the process chamber. Furthermore, the delivered feed solutions are subject to concentration fluctuations due to the production process. All of these fluctuations lead to varying results for products produced in demanding processes, and in the worst case, to rejection or failures in use of the products to be made. In addition, it is hard to fulfil in practice the requirement that only substances used are to be present in the feed solution.

In the US patent application 2004/0142566 A1, it is suggested that a smaller amount of the bath is replaced in shorter time intervals, so that the total desired refill is achieved gradually over a time period of 24 hours. In this method, the typical interval time of 24 hours is reduced to 30-60 minutes. In the method known in this U.S. patent application, bleed solution is taken from the storage tank, and dispensed into a second container, and the amount of bleed solution in the second container is measured and then disposed of. Subsequently, the second container is filled with a predetermined amount of a new solution (feed solution) from the storage tank, and the predetermined amount of feed solution is dispensed into the storage tank, in order to ensure that the fed and discharged volume is the same, and therefore does not change the volume in the tank.

Finally, the disadvantage of this method is that is does not work continuously over a longer period. Furthermore, due to the intermediate storage of bleed and feed solutions in the second container, there is the danger of contamination of the feed solution.

The object of the present invention is to provide a bleed and feed method, in which contamination is avoided, which works quasi-continuously or continuously, and can be implemented in demanding processes such as the production of semi conductor elements, as well as to give a system in which the method can be carried out.

The object is achieved according to the invention by the features of claims 1 and 13.

In the method according to the invention, a first receiving space G1 for the feed solution is provided between the tank T1 for the feed solution and the process tank PT, and correspondingly, a second receiving space G2 for the bleed solution is provided between the process tank PT and the tank T2 for the bleed solution. The first receiving space G1 is filled with feed solution from the tank T1. Subsequently, the feed solution is pumped from the first receiving space G1 by means of a pump into the process tank, whereby the volume of the amount of feed solution delivered into the process tank is measured.

In a similar way, by measuring the volumes of the bleed solution, the bleed solution is pumped by means of the pump P3 from the process tank PT into the second receiving space G2 for the bleed solution, and the bleed solution is subsequently emptied into tank T2.

The contamination of the feed solution is avoided as a result of the feed solution according to the invention being temporarily stored in a different receiving space from the bleed solution.

Furthermore, in order to increase the accuracy of the respective volume flows, according to the invention the volumes into or out of the process tank PT are not only measured, but also calculated on the basis of the pumping power of the pumps P2 and P3, and a correction factor is calculated from the difference of the measured and calculated volumes, which is used to correct the nominal delivery volume of the pumps P2 and P3 in the next cycle.

In order to guarantee the required accuracy of the process, the containers G1 and G2 should be constructed in such a way that the error in determining volumes in these containers should be less than 0.1%, preferably less than 0.05%, and particularly preferably, less than 0.02%.

The absolute volume of G1 and G2 is determined by the maximal required bleed and feed rate, the volume of the process tank PT and the required process window, whereby the dispensing accuracy depends purely and simply on the reproducibility of the volumes of containers G1 and G2 over a much longer time period.

The volume flow of the feed solution for filling the first receiving space G1 is preferably a multiple of the volume flow of the feed solution out of the first receiving space G1 into the process tank PT, in particular at least double, preferably at least 5 times the value, and particularly preferably, at least 20 times the value. Due to the high volume flows into the first receiving space G1, and the short filling period resulting from this, higher accuracy can be achieved by the control according to the invention.

The time, in which the bleed solution is pumped by means of the pump P3 from the process tank PT into the second receiving space G2, should also be a multiple of time in which the bleed solution is emptied out of the second receiving space G2 into the tank T2, preferably at least double.

A continually working method can be realised in that filling the first receiving space G1 (or emptying the receiving space G2) by tank T1 (or into Tank 2), and emptying the first receiving space G1 (or filling the receiving space G2) into the or out of the process tank PT is done by different pipelines, and the pumps P2 and P3 are not switched off during a bleed and feed cycle. In this process, the signals of sensors S1, S2, S3 and S4 in/on the first and second receiving space G1 and G2 are used for calculating the correction factors K1 and K2 for the pumps P2 and P3.

In contrast to this continuously working system, in the previously described easier system, the sensors are exclusively used to refill the container G1 and to empty the container G2. The result of this is that the filling quantity is always constant, and so can be used for calculation of the correction factor.

Furthermore, this correction can be improved in that the volume correction $V_{K1}$ of the first interim container G1 of the next cycle is calculated from the nominal volume, the correction volume of the last cycle $V_{1K-1}$, the calibrated volume $V_{G1}$ and the volume delivered by the calibrated filling level. The failed volume of the last cycle is therefore corrected in the next cycle by means of the nominal quantity of the complete last cycle multiplied by the quotient from the new and old correction factor. This amount must then be transmitted in the volume flow offset for a certain period, which should be short, if possible, and should be maximal one cycle.

In the frame of the present invention, a characteristic curve correction of the pumps P2 and P3 is therefore carried out. The correction of the feed volume flow for external feed flows and the correction of the bleed volume flow for external bleed flows (for example, by evaporation, analysis etc) also takes place.

Due to the corrections according to the invention, synchronicity of the bleed and feed flows is not possible.

Furthermore, the invention relates to a system for carrying out a bleed and feed method, which comprises a tank T1 and T2 for each feed or bleed solution, as well as a first receiving space G1 for interim storage of the feed solution and a second receiving space G2 for interim storage of the bleed solution, and a process tank PT as well as pumps P1, P4 for liquid transport between tank T1, T2 and receiving space G1, and G2 and pumps P2, P3 for liquid transport between the receiving space G1, G2 and the process tank PT, sensors S1, S2, S3 and S4 for triggering predetermined filling levels in the receiving spaces G1, G2, valves (V1, V4), as well as a process control computer PR, which controls the flow of the bleed or feed solution out of or into the process tank PT.

Of course, the method according to the invention can also be carried out with several feed systems and also with several bleed systems and several feed systems, whereby for each system, corresponding receiving spaces, tanks and pumps are to be provided.

The invention also concerns the extension of the bleed and feed system by an analysis system, and by an additional system for processing of the bleed solution. The correction of the volume flow can be done by analysis of the bleed substances, analysis of the feed substances and/or analysis of the reprocessed bleed liquid.

The invention will be described in more detail using the following embodiments.

In the drawings:

FIG. 1 shows the construction in principle of the bleed and feed device according to the invention, FIG. 2 shows the signals of the sensors and regulation of the pumps during a bleed and feed cycle with concentration course and volume course depending on the time for the system according to FIG. 1.

FIG. 3 the bleed and feed device from FIG. 1 with a separate supply and removal into or from the receiving spaces G1 and G2, FIG. 4 shows the signals of the sensors and regulation of the pumps during a bleed and feed cycle with concentration course and volume course depending on the time for the system according to FIG. 3.

Figure 1:
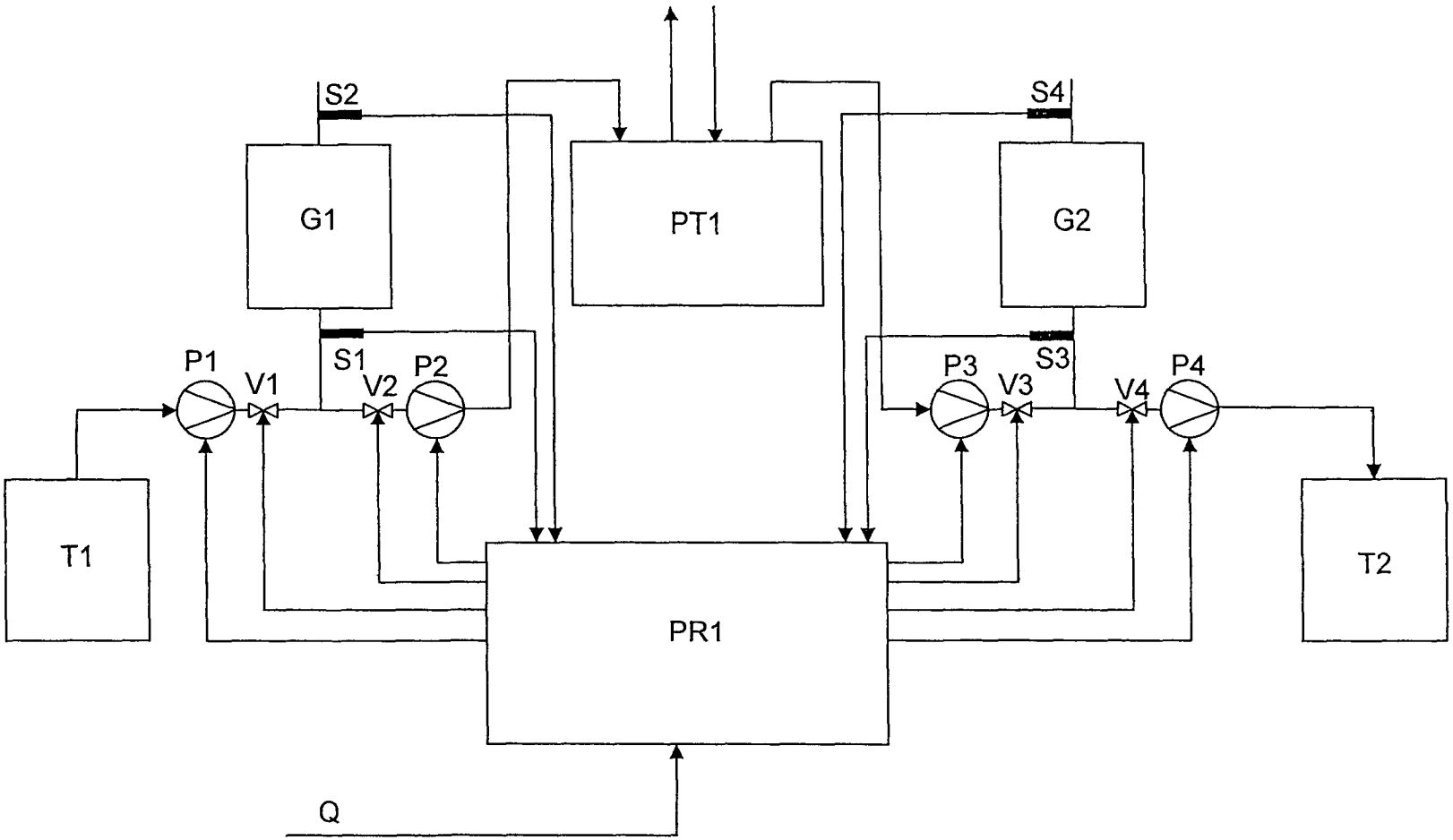

The construction in principle of the bleed and feed system is shown in FIG. 1. The feed solution is pumped with a high rate of flow out of tank T1 with the pump P1, opened valve V1 and closed valve V2 into the first receiving space G1 for the feed solution, which is formed as an interim container. The sensor S2 responds, so the valve V1 is closed and pump P1 is stopped (cf. also FIG. 2). This filling process of the interim container typically lasts a few seconds, up to a maximum of a few minutes.

Subsequently, the pump P2 is started and the valve V2 is opened. The process control computer PR controls the flow rate of the pump P2, in order to obtain the desired volume flow of the feed solution into the process tank PT, whereby the interim container is emptied. The sensor S1 responds, so valve V2 is closed and pump P2 switched off (cf. FIG. 2) and the filling process of the interim container G1 begins again, as described above.

A feed cycle can last typically between 30 minutes up to several hours.

The same principle as the feed solution is followed for the bleed solution. The bleed solution is pumped by means of the pump P3 out of the process tank PT with the opened valve V3 and closed valve V4 into the second receiving space G2 for the bleed solution, which in this embodiment is also formed as an interim container G2. The sensor S4 responds, so valve V3 is closed and pump P3 switched off. The interim container G2 is subsequently emptied with a high flow rate into the tank T2, in which the pump P4 is switched on and the valve V4 is opened. The sensor S3 responds, so valve V4 is closed and pump P4 switched off.

Subsequently, pump P3 is switched on and valve V3 is opened, and a new bleed cycle begins. A cycle can typically last from 30 minutes up to several hours.

The volume between the responses of the sensor S2 and the decrease of the sensor S1 in the interim container G1, which includes the corresponding mixture of chemicals, must be precisely measured. A corresponding method is used with the second interim container G2.

Therefore the measured volume $V_{FE}$ and $V_{BL}$, which the pumps P2 and P3 delivered in a cycle in a certain time period, is known.

The construction of the interim containers G1 and G2 with the associated sensors S1, S2, S3 and S4 must be formed so that a very high repeat accuracy (long-term stability) of the calibrated volume in G1 and G2 is guaranteed.

When short-term stable types of pump are used for P2 and P3, the process control computer PR can exactly calculate the delivery volume for each time. In each cycle, a correction factor can be generated for each pump P2 and P3. With these correction factors, the nominal value delivery volumes of the pump are corrected, so that the control can set the pumps very exactly to an exact delivery volume. These correction values are newly calculated for each cycle and adapted for the next cycle if necessary. After completion of a cycle, if a difference between the nominal and actual volumes is found, this will be taken into account in the calculation of the delivery volumes in the next cycle, and possible mistakes are corrected.

If a seal develops on the pump P2 or P3, this quickly changes the correction factor, or the correction factor differs greatly from its nominal value. This can be determined by the process control computer PR, and the user is given a tip on a necessary repair, before it comes to a failure.

The pump time of the pumps P1 and P4 is to be monitored in the same way. A tip can be given to the user on a large change of value, although the accuracy requirements on P1 and P4 are not so large. It is only important that the maximum filling or emptying times are not exceeded. The accuracy achieved depends exclusively on the accuracy of the absolute volume of the containers G1 and G2 (or the accuracy of the respective filling volumes).

For volume accuracy of the containers used, with the system and method for absolute exchanged volumes, an accuracy of 0.05% and therefore volume differences between the bleed and feed solution of less than 0.1% are achieved.

In the embodiment shown in FIG. 1, the filling pipe and the intake pipe for the first interim container G1 are the same pipe, and the feed pumps P2 and P3 are switched off, for increasing the accuracy of filling the first interim container G1 for the feed solution with the pump P1, and emptying the second interim container G2 for the bleed solution with the pump P4. If the pumps P2 and P1 are switched on at the same time, the flow rate (due to the increased pressure from the pump) would vary greatly from P2. This would lead to a greater inaccuracy. The same applies to the second interim container G2.

Figure 2:
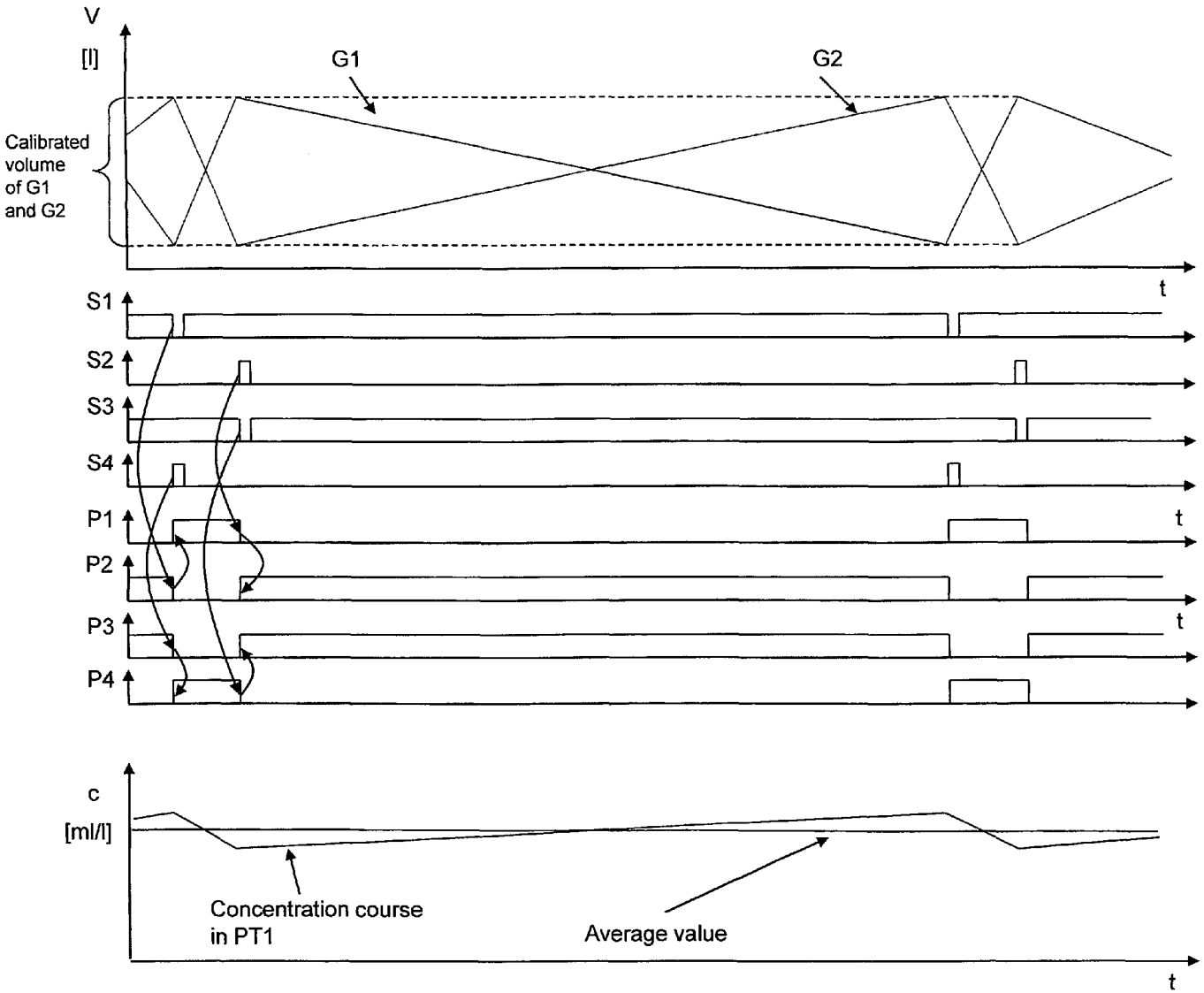

The device and method in FIG. 1 work quasi-continuously. The concentration course in FIG. 2 is still slightly sawtoothed. By comparison of the measured and calculated volume flows, and calculation of the correction factors of the pumps P2 and P3 in each cycle, an extraordinarily high accuracy, and therefore reliability of the method, is achieved.

Figure 3:
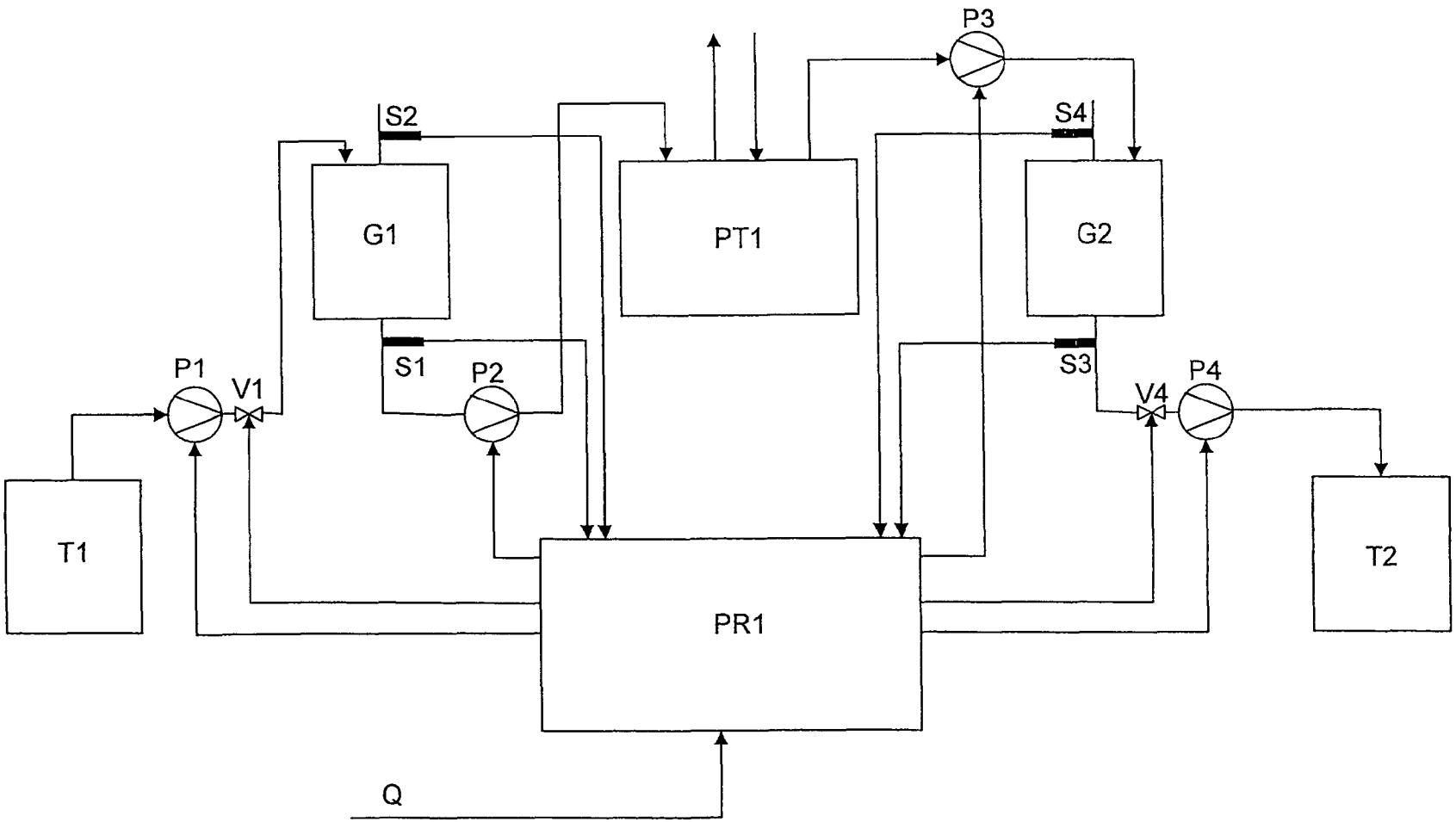
Figure 4:
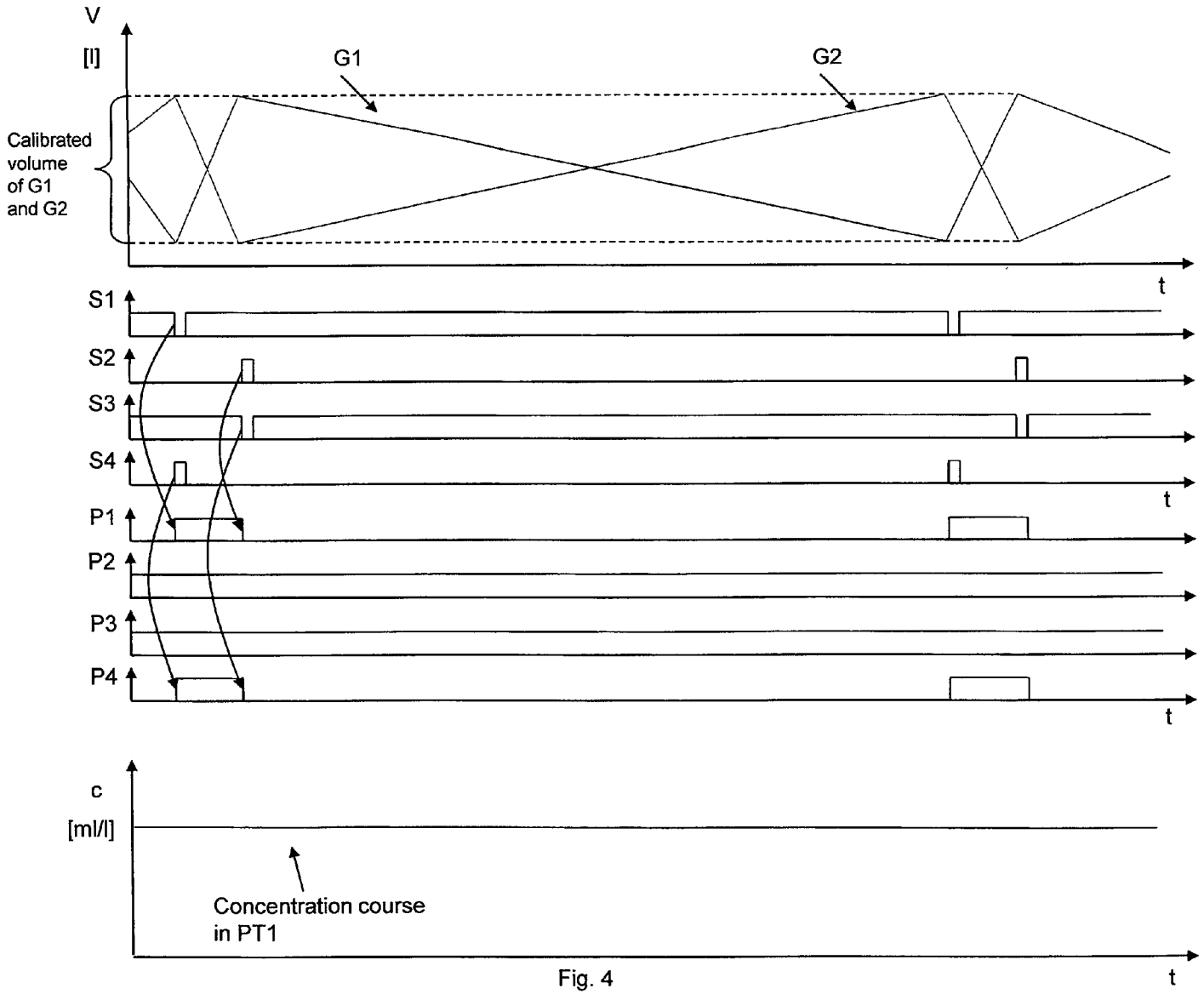

A complete, continuously working bleed and feed system is shown in FIG. 3. Here the pipes and AnL are used separately. This also allows the bleed and feed pumps P2 and P3 to continue during the filling of the first interim container G1 and the emptying of the second interim container G2. Through this, that even after the decrease of sensor S1, a sufficient volume of the feed solution to be pumped into the process tank PT is available, the pump P2 delivers constant feed solution into the process tank PT, therefore also in contrast to FIG. 1, if the interim container G1 is filled short term from T1 with feed solution (cf. FIG. 4). Correspondingly, bleed solution is continuously pumped by the pump P3 out of the process tank PT, also in the period in which bleed solution is pumped by pump 4 out of the interim container G2 into the tank T2 at a higher flow rate. Once the flow of the feed solution into the process tank PT and the flow of the bleed solution out of the process tank are constant, since the pumps P2 and P3 are not switched off, and therefore there is no down time, the concentration in the process tank is constant in terms of time, and the bleed and feed process works continuously.

Also in this embodiment, the process control computer PR gathers the delivered volumes and generates the correction factors. Through this, the constancy of the concentration in the process tank PT can be further increased, without influencing the accuracy of the volume difference and the volumes exchanged.

Figure 5:
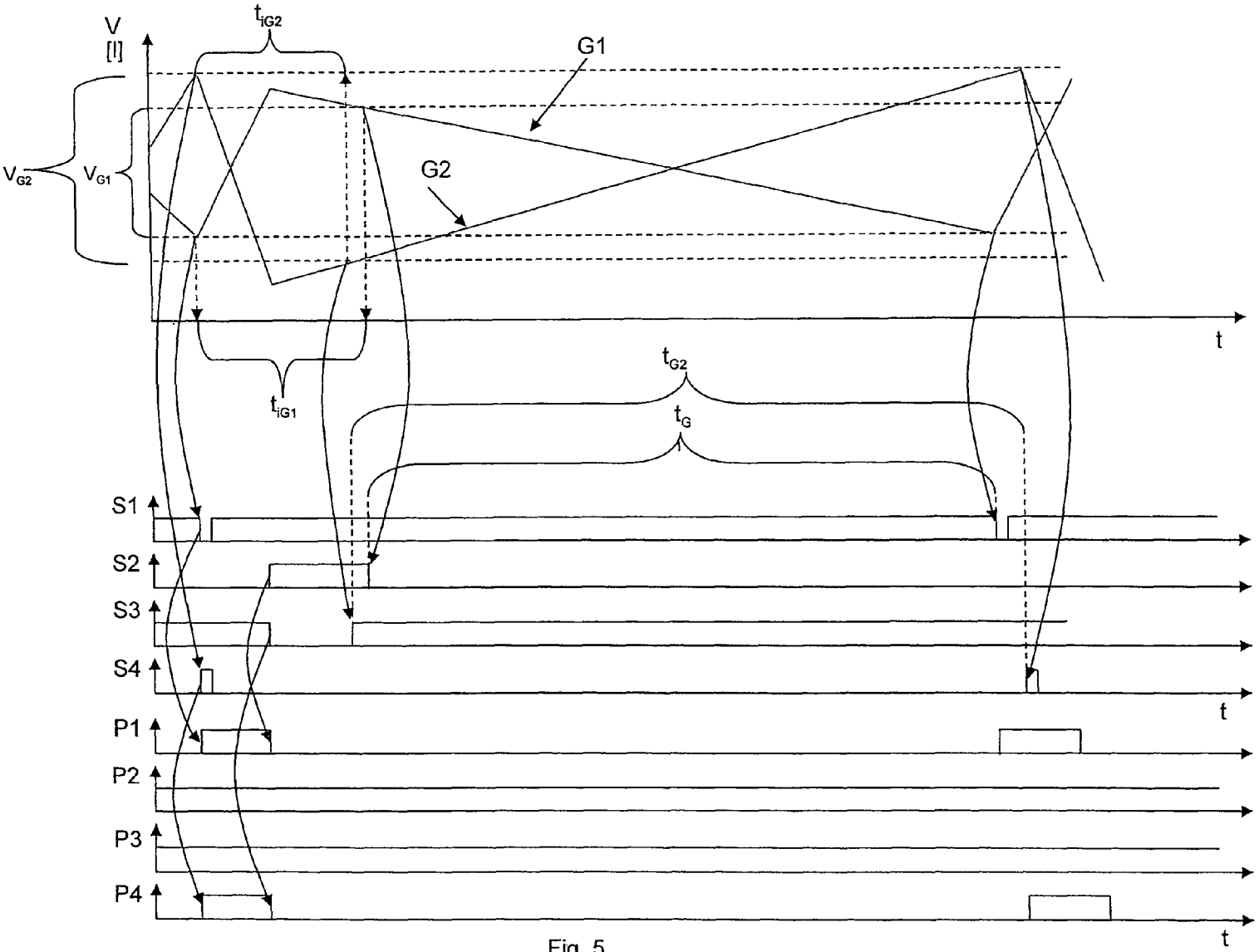
FIG. 5 shows the signals of the sensors and regulation of the pumps during a bleed and feed cycle according to adjustment of tolerance-related inaccuracy for the system in FIG. 3.

In the context of the present invention, furthermore, tolerance-related inaccuracies can be reduced, as is shown as an example in FIG. 5.

The filling quantity for filling the first interim container G1 and for emptying the second interim container G2 can vary according to the pumps (P1, P4) and valves (V1, V4) used. For example, the first interim container G1 can be overfilled, if the pump P1 is not immediately switched off when the maximal position of the sensor S2 is reached, since the flow rate of pump P1 into the interim container G1 is high. In this case, the volume of feed solution pumped into the first interim container G1 'overshoots' the calibrated volume $V_{G1}$.

Equally, a reduction of the volume $V_{G2}$ of the bleed solution can occur, since on reaching the minimal position of the sensor S3, the fast pump P4 is not immediately switched off. Since the emptying of the fist interim container G1 is done slowly with the pump P2, also the filling of the second interim container G2 with P3, the process control computer PR in this variant uses the sensor signals (S1, S2, S3 and S4) for calculating the correction factors, whereby a very high accuracy can be achieved.

These inaccuracies described as examples, and all others, whenever and wherever they come from, are corrected in the next cycle. The requirement is simply that G1 and G2 are not completely empty (the following pumps draw air) and G1/G2 do not overflow.

During a feed cycle, the calibrated volume $V_{G1}$ of the interim container G1 is dispensed over the time period $t_{iG1}$. Furthermore, in the time period $t_{iG1}$, an additional volume is dispensed, which is calculated from the integration of the delivery volume of the pump P2 by the integration time $t_{iG1}$. $t_{iG1}$ is the time interval between the failing edge of the sensor (S1) and the failing edge of the sensor S2.

Figure 6:
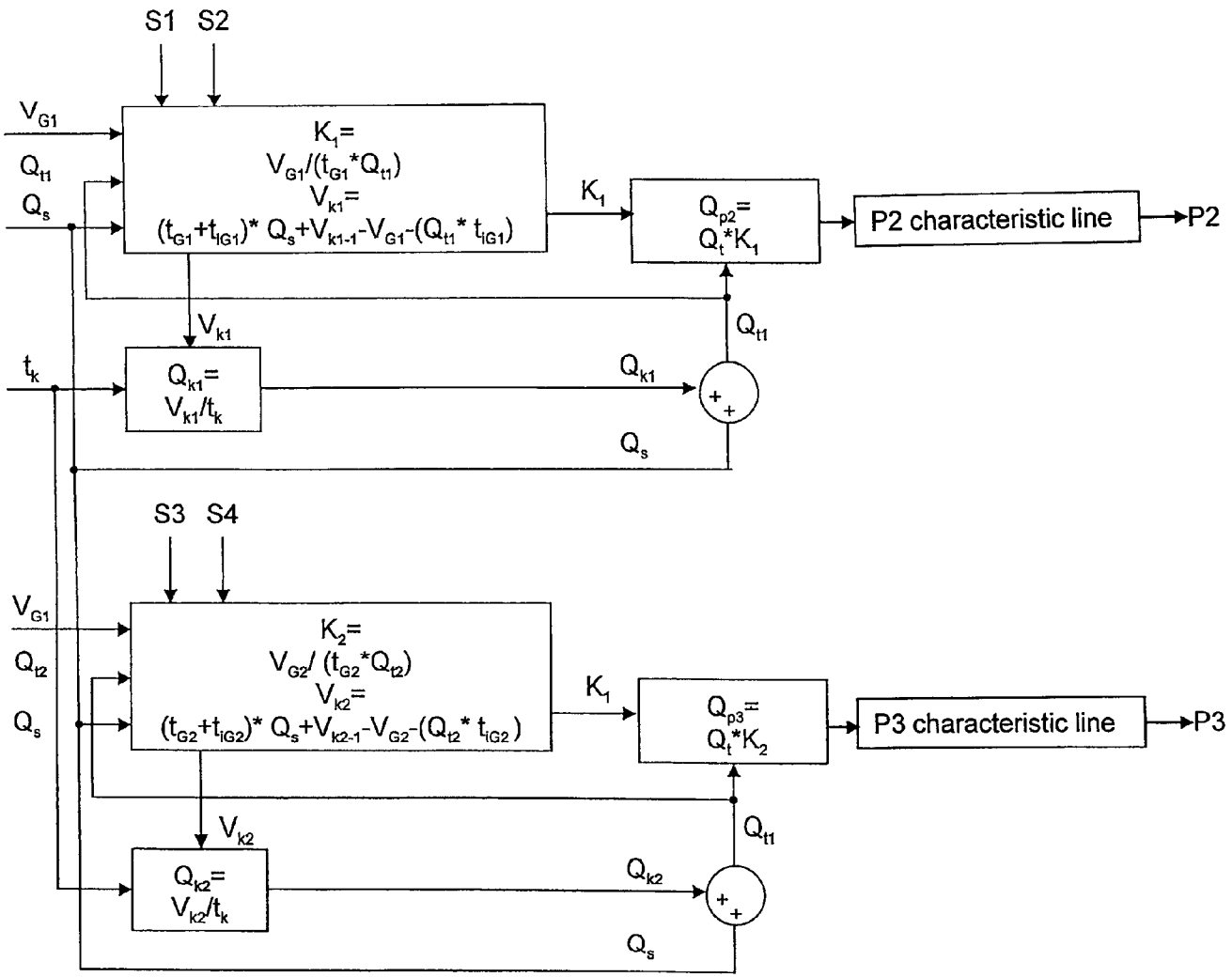
FIG. 6 shows a block diagram of regulation and control of the pumps for the device in FIG. 3.

In the same way, the volume of the bleed cycle is calculated from the calibrated volume $V_{G2}$ of the second interim container G2 and the additional delivery volumes integrated by $t_{iG2}$. Due to these improvements, the system is less vulnerable to tolerances which develop in production and while the system is in operation. In FIG. 6, the block diagram of regulation and control of pumps P2 and P3 are shown for the variants according to FIG. 5. This shows one of several implementation possibilities.

The meaning of individual formulas and parameters in FIG. 6 are as follows:

$$K_1 = \frac{V_{G1}}{\int_{t_{G1}} Q_1(t)dt}$$

$K_1$ correction factor for pump P2

$V_{G1}$ calibrated volume of G1 (actual volume)

$\int_{t_{ti}} Q_2(t)dt$ the nominal volume in the first interim container G1

$t_{G1}$ time interval between the failing edge of S2 and the failing edge of S1 (see FIGS. 5 and 6).

$Q_1(t)$ volume flow of pump 2 to time point t $V_{k1}=\int_{t_{C1}+t_{iC1}} Q_s(t)dt+V_{1k-1}-V_{G1}-\int_{t_{iC1}} Q_1(t)dt$ $V_{k1}$ volume by which the next cycle must be corrected $\int_{t_{C1}+t_{iC1}} Qs(t)dt$ nominal volume $V_{1k-1}$ correction volume from last cycle $V_{G1}$ calibrated volume of G1 (actual volume)

$\int_{t_{iC1}} Q_1(t)dt$ volume which is filled by the calibrated filling level $t_{iG1}$ time interval between failing edge of S1 and failing edge of S2 (see FIG. 5)

$Q_{k1}=V_{k1}/t_k$ $Q_{k1}$ volume flow (constant during $t_k$), which is necessary to correct the volume $V_{k1}$ $t_k$ time in which the volume $V_{k1}$ should be corrected (a short time is chosen so that it can be compared as quickly as possible with $V_{k1}$)

For pump 3, bleed is the same process as in pump 2 feed, and shown in FIG. 6.

Enhancement with Subsequent Dispensing

There are applications, in which decomposition products or accumulations of materials develop, which can only be diluted by a bleed and feed system, but despite this, cannot be kept constant with a feed solution of all material concentrations. In these cases, individual substances are added to the process tank PT according to individual use.

Figure 7:
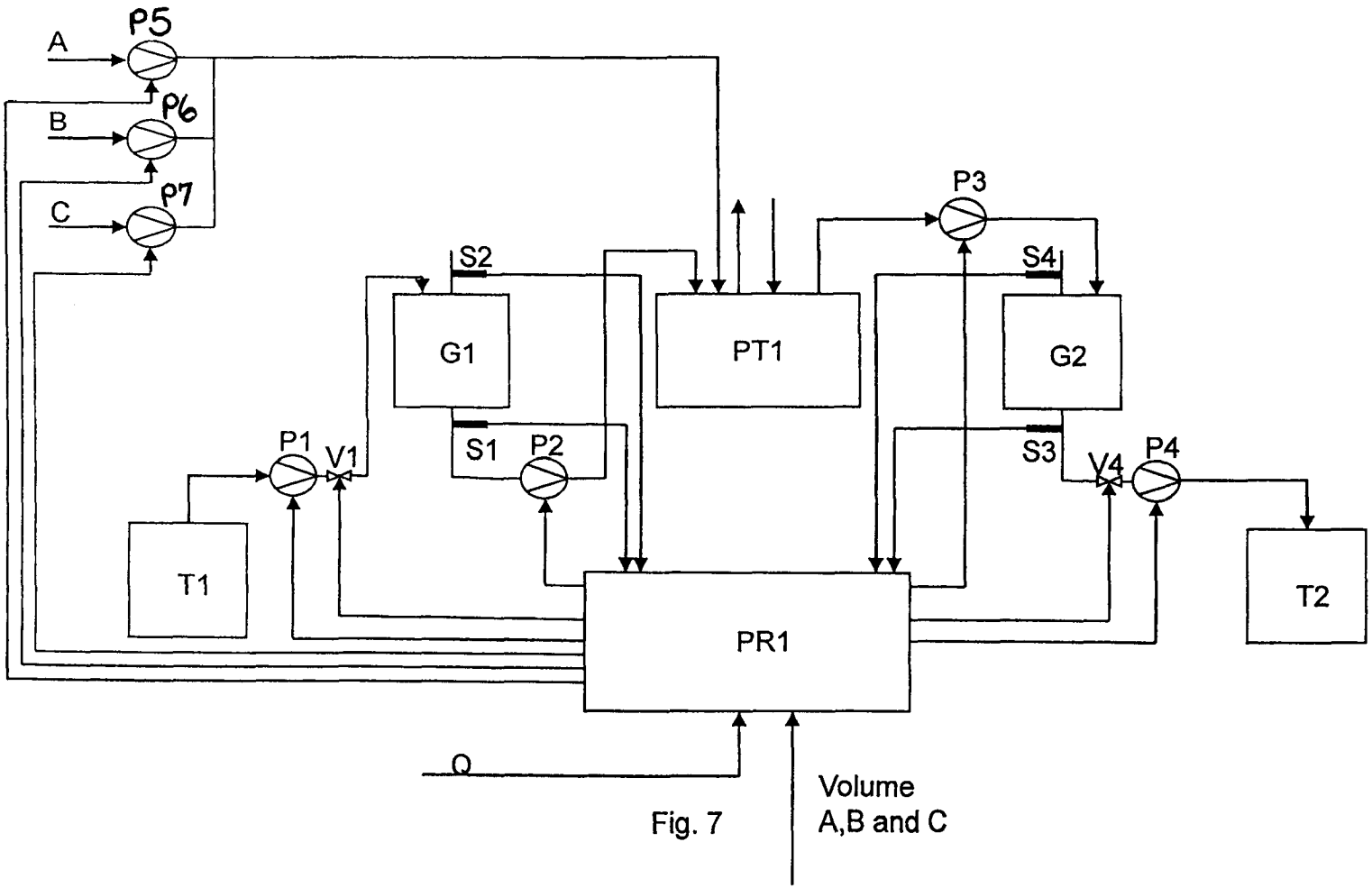
FIG. 7 shows a bleed and feed system with subsequent dispensing.

A schematic example is shown in FIG. 7, in which the substances A, B and C are added by each pump P5, P6 and P7, controlled by PR. The result of this, is that on addition of A, B or C or in any respective combination of substances, the volume flow of the feed solution must be reduced, so as not to upset the balance of inflow and outflow of the process tank PT. It is also possible that the volume flow of the bleed solution will be raised accordingly. Which system gives the best results always depends on the composition and behaviour of the chemicals.

Enhancement with an Analysis System

The bleed and feed solutions described here are controlled externally, mostly by production throughput. In many cases, this leads to good results and to a relatively long lifespan of the baths. A closed-loop control can be achieved with the addition of an analytical system to the bleed and feed system. The analysis system must be able to determine the individual material concentrations, which are important for the production results.

Figure 8:
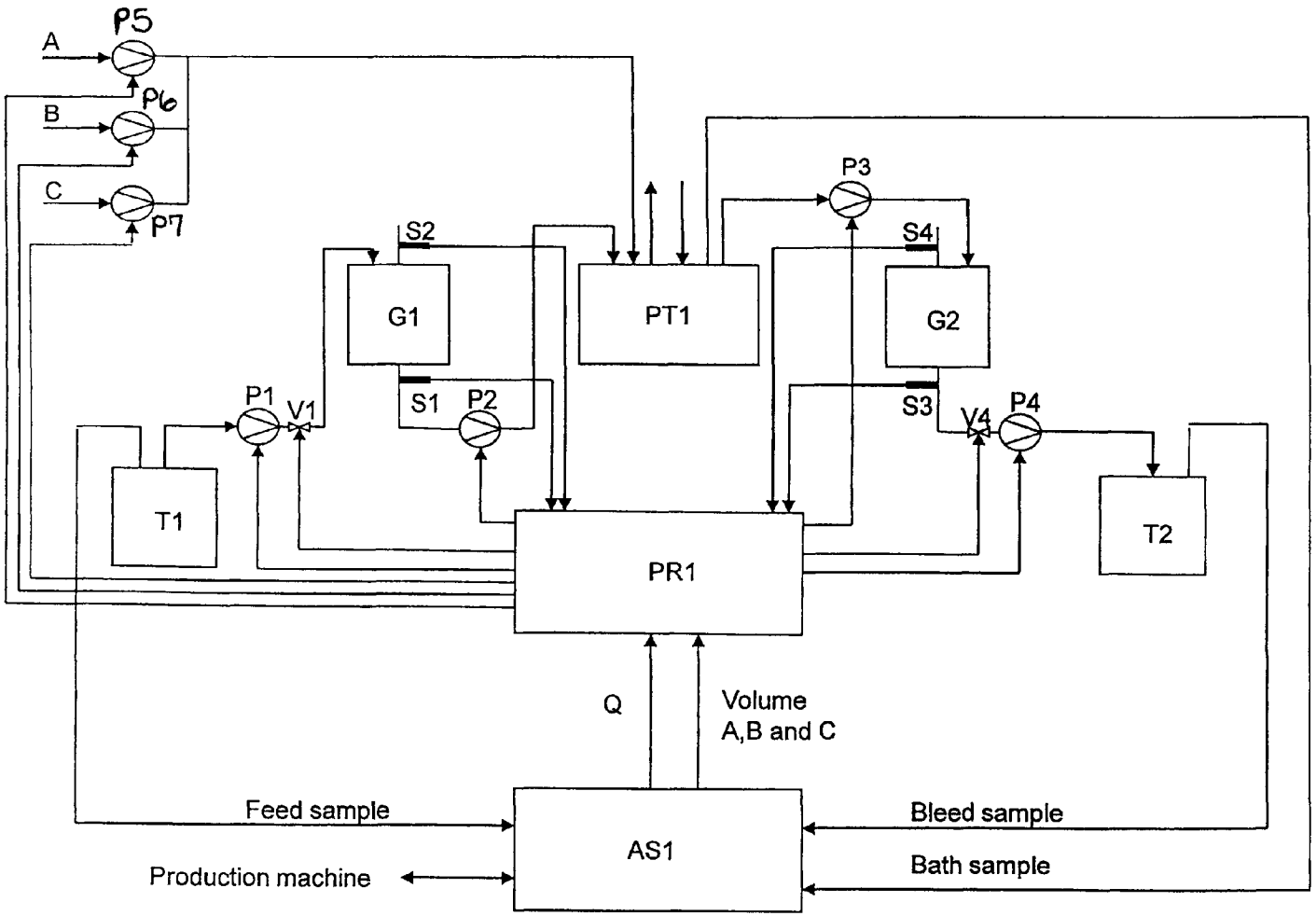
FIG. 8 shows a bleed and feed system with an additional analysis system.

A possible variant of a bleed and feed device with a coupled analysis system AS is shown in FIG. 8. The analysis system AS in FIG. 8 analyses in each case, when the feed solution is dispensed into T1, when this is changed, or T1 is replaced as a whole. The necessary volume flow Q is calculated for the bleed and feed system in dependence upon the material concentrations. Therefore a feed solution, which does not exactly correspond to the theoretical concentration, can be used. Accordingly, the volume flows for a predetermined production throughput are corrected in the process control computer.

During production, material concentrations in the process tank PT are regularly determined by using the analysis system AS. According to the results, Q is adapted for the bleed and feed system, and, if necessary, the additional components such as for example A, B and C are subsequently dispensed, in order to keep the material concentrations in the process tank PT as close as possible to the nominal value. The bleed tank T2 in FIG. 8 is analysed at regular intervals, in order to check the efficiency of the system.

Enhancement with a Processing System

Figure 9:
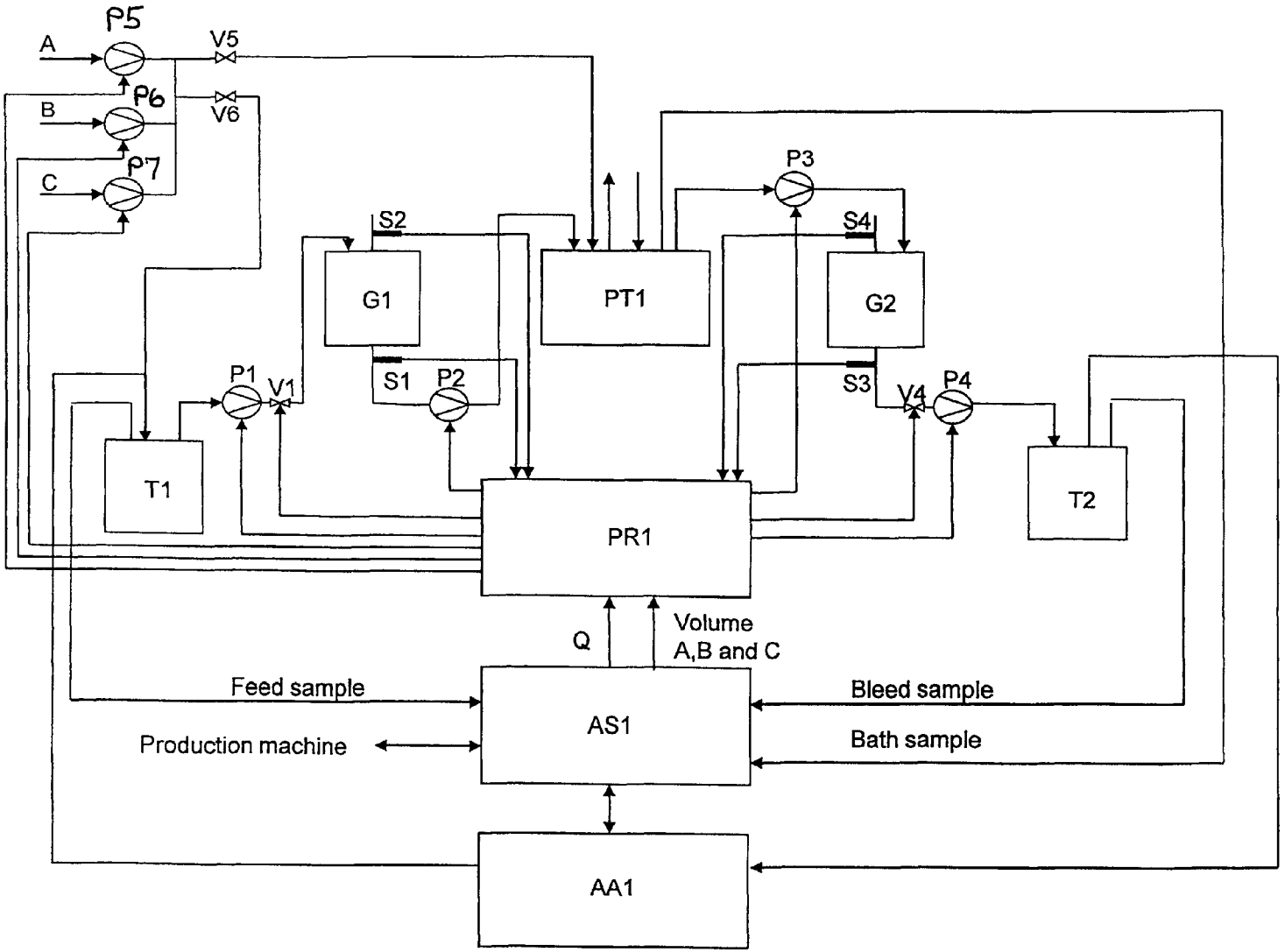
FIG. 9 shows a bleed and feed system with additional analytics and processing.

A closed circuit results when a bleed and feed system with an analytical system is also coupled with a processing system, as shown in FIG. 9. This considerably reduces waste generated by the production, and also reduces production costs.

Up to now, systems are only known in which the bleed solution is prepared in a batch process, with the bleed and feed solutions having to be transported. Transport can be avoided with this integrated system. Environmental damage is reduced by the absence of transport, and equally so is the risk of environmental pollution caused by an accident during transportation. The total costs are also further reduced by enhancement with a processing system.

The invention is described in more detail by means of the following example.

Example of an Integrated Processing System

In production of semiconductors, copper is deposited on wafers. The copper bath typically contains copper sulphate, sulphuric acid, chloride and several organic bonds. In the bleed solution of a bath of this type, the decomposition products of the organic bonds are the limiting factor for the lifespan of a bath of this type. The organic bonds can be completely broken down by UV oxidation and/or chemical means in a processing system.

After cleaning, the organic materials are again added to the feed tank T1 (as shown in FIG. 9 as A, B and C and valve V6). Typically, additives are also used in order to keep the nominal concentrations constant in the process tank PT. This is also done by the pumps of A, B and C and valve V5.

This type of processing can also be used for other chemical production processes. Different techniques can be used such as filtration, electrolysis, preparative HPLC and others.

The invention claimed is:

1. Method for carrying out a bleed and feed of process solutions in a process tank, in which the feed solution is pumped out of a first tank (T1) into a first receiving space (G1) for the feed solution, and the first receiving space (G1) is subsequently emptied into the process tank (PT) by means of a second pump (P2), whereby the volume of the delivered amount of feed solution in the process tank (PT) is measured, in which the bleed solution is pumped out of the process tank (PT) by means of a third pump (P3) into a second receiving space (G2) for the bleed solution, whereby the volume of the delivered amount of bleed solution from the process tank (PT) in the second receiving space (G2) is measured, and the bleed solution in the second receiving space (G2) is subsequently emptied into a second tank (T2), and whereby the first receiving space (G1) is different from the second receiving space (G2), and whereby at least one correction factor is always calculated from a comparison of the measured and calculated volumes of the bleed and feed solution delivered by the second and third pumps (P2) and (P3), with which said at least one correction factor the nominal delivery volume of the second and third pumps (P2) and (P3) are corrected in the next cycle.

2. Method according to claim 1, characterized in that the first and second receiving spaces (G1) and (G2) are constructed in such a way that error in determining the volumes is less than 0.1%.

3. Method according to claim 1, characterized in that the volume flow of the feed solution for filling the first receiving space (G1) from the first tank (T1) is at least double the value of the volume flow of the feed solution for filling the process tank (PT).

4. Method according to claim 1, characterized in that the time, in which the feed solution is emptied out of the first receiving area (G1) into the process tank (PT) by means of the second pump (P2), is a multiple of the time in which the feed solution is pumped out of the first tank (T1) into the first receiving space (G1).

5. Method according to claim 1, characterized in that the filling of the first receiving space (G1) by the first tank (T1) and the emptying of the first receiving space (G1) into the process tank (PT) is done by the same pipe, and a first pump (P1) is switched off on use of the second pump (P2), and the second pump (P2) is switched off on use of the first pump (P1).

6. Method according to claim 1, characterized in that the filling of the first receiving space (G1) by the first tank (T1), and the emptying of the first receiving space (G1) into the process tank (PT) is done by different pipes, and the second pump (P2) and the third pump (P3) are not switched off during a bleed and feed cycle.

7. Method according to claim 6, characterized in that sensors (S1, S2, S3, S4) for determining the filling level are provided on or in the first and/or second receiving space (G1, G2), and the sensor signals are used in the calculation of correction factors (K1, K2) for the second pump (P2) and the third pump (P3), respectively.

8. Method according to claim 6, characterized in that a first volume correction factor ($V_{K1}$) of the first interim container (G1) after the next cycle is calculated from a nominal volume, a correction volume of the last cycle ($V_{1k-1}$) a calibrated volume ($V_{G1}$) and a volume filled by a calibrated filling level.

9. Method according to claim 6, characterized in that the first and second receiving spaces (G1 and G2) are constructed in such a way that error in determining the volumes is less than 0.1%.

10. Method according to claim 6, characterized in that the volume flow of the feed solution for filling the first receiving space (G1) from the first tank (T1) is at least double the value of the volume flow of the feed solution for filling the process tank (PT).

11. Method according to claim 6, characterized in that the time, in which the feed solution is emptied out of the first receiving area (G1) into the process tank (PT) by means of the second pump (P2), is a multiple of the time in which the feed solution is pumped out of the first tank (T1) into the first receiving space (G1).

12. Method according to claim 1, characterized in that a characteristic correction of the second pump (P2) and the third pump (P3) takes place.

13. Method according to claim 1, characterised in that the correction of the feed volume flow for external feed flows and/or the correction of the bleed volume flow is done by external bleed flows.

14. Method according to claim 1, characterised in that the correction of the volume flows is done by analysis of the feed and/or bleed substances and/or by analysis of the reprocessed bleed solution.

15. Method according to claim 1, characterised in that the bleed and feed flows are not synchronous.

16. Method according to claim 1, characterized in that the emptying of the second receiving space (G2) into the second tank (T2) and the filling of the second receiving space (G2) from the process tank (PT) is done by the same pipe, and a fourth pump (P4) is switched off on use of the third pump (P3), and the third pump (P3) is switched off on use of the fourth pump (P4).

17. Method according to claim 1, characterized in that the emptying of the second receiving space (G2) by the second tank (T2), and the filling of the second receiving space (G2) from the process tank (PT) is done by different pipes, and the second pump (P2) and the third pump (P3) are not switched off during a bleed and feed cycle.

18. Method according to claim 1, characterized in that the first and second receiving spaces (G1) and (G2) are constructed in such a way that error in determining the volumes is less than 0.05%.

19. Method according to claim 1, characterized in that the first and second receiving spaces (G1) and (G2) are constructed in such a way that error in determining the volumes is less than 0.02%.

20. Method according to claim 1, characterized in that the volume flow of the feed solution for filling the first receiving space (G1) from the first tank (T1) is at least five times the value of the volume flow of the feed solution for filling the process tank (PT).

21. Method according to claim 1, characterized in that the volume flow of the feed solution for filling the first receiving space (G1) from the first tank (T1) is at least 20 times the value of the volume flow of the feed solution for filling the process tank (PT).

22. Method according to claim 1, characterized in that the time, in which the feed solution is emptied out of the first receiving area (G1) into the process tank (PT) by means of the second pump (P2), is at least double the time in which the feed solution is pumped out of the first tank (T1) into the first receiving space (G1).

23. Method according to claim 1, characterized in that the time, in which the feed solution is emptied out of the first receiving area (G1) into the process tank (PT) by means of the second pump (P2), is at least 5 times the time in which the feed solution is pumped out of the first tank (T1) into the first receiving space (G1).

24. Method according to claim 1, characterized in that the time, in which the feed solution is emptied out of the first receiving area (G1) into the process tank (PT) by means of the second pump (P2), is at least 20 times the time in which the feed solution is pumped out of the first tank (T1) into the first receiving space (G1).

* * * * *